US006002316A

United States Patent [19]

McIntyre et al.

[11] Patent Number: 6,002,316

[45] Date of Patent: Dec. 14, 1999

[54] SUPERCONDUCTING COIL AND METHOD OF STRESS MANAGEMENT IN A SUPERCONDUCTING COIL

[75] Inventors: Peter M. McIntyre, College Station, Tex.; Weijun Shen, Oak Ridge, Tenn.; Nick Diaczenko; Dan A. Gross, both of College Station, Tex.

[73] Assignee: The Texas A&M University System, College Station, Tex.

[21] Appl. No.: 09/079,090

[22] Filed: May 13, 1998

[51] Int. Cl.[6] ..... H01H 6/06

[52] U.S. Cl. ..... 335/216

[58] Field of Search ..... 335/216; 336/DIG. 1; 505/211, 212, 213, 704, 705, 876, 877, 878, 879, 880; 174/15.4, 15.5, 125.1

[56] References Cited

U.S. PATENT DOCUMENTS

| | | | |
|---|---|---|---|
| 4,994,633 | 2/1991 | Puhn | 174/125.1 |
| 5,315,277 | 5/1994 | Eyssa et al. | 335/216 |
| 5,332,988 | 7/1994 | Zhukovsky et al. | 335/216 |
| 5,384,197 | 1/1995 | Koyama et al. | 428/457 |

*Primary Examiner*—Michael L. Gellner
*Assistant Examiner*—Raymond Barrera
*Attorney, Agent, or Firm*—Baker & Botts, L.L.P.

[57] ABSTRACT

A superconducting coil (12) having a plurality of superconducting layers (18) is provided. Each superconducting layer (18) may have at least one superconducting element (20) which produces an operational load. An outer support structure (24) may be disposed outwardly from the plurality of layers (18). A load transfer system (22) may be coupled between at least one of the superconducting elements (20) and the outer support structure (24). The load transfer system (22) may include a support matrix structure (30) operable to transfer the operational load from the superconducting element (20) directly to the outer support structure (24). A shear release layer (40) may be disposed, in part, between the superconducting element (20) and the support matrix structure (30) for relieving a shear stress between the superconducting element (20) and the support matrix structure (30). A compliant layer (42) may also be disposed, in part, between the superconducting element (20) and the support matrix structure (30) for relieving a compressive stress on the superconducting element (20).

20 Claims, 2 Drawing Sheets

SUPERCONDUCTING COIL AND METHOD OF STRESS MANAGEMENT IN A SUPERCONDUCTING COIL

GOVERNMENT CONTRACT

This invention was invented under contract from the Department of Energy, contract number DE-FG03-95ER40924.

TECHNICAL FIELD OF THE INVENTION

The present invention relates generally to superconductors, and more particularly to a superconducting coil and method of stress management in a superconducting coil.

BACKGROUND OF THE INVENTION

Superconductive materials have the unique material property of having zero electrical resistance. In other words, superconductive materials can conduct electricity with no loss of energy. However, superconductive materials only exhibit this unique material property when cooled below their respective critical temperature. The critical temperature for superconductive materials is in the supercold or cryogenic range of temperatures.

Superconductive materials are particularly useful in applications that utilize a magnetic field. Such applications include, for example, electric motors and generators, transformers, magnetic energy storage devices, magnetic bearings, colliders, and the like. The magnetic field that can be generated using superconductive materials is far greater than the magnetic field that can be produced using conventional conductive materials, such as copper. For example, some applications of magnetic resonance imaging (MRI) require a high magnetic field that can only be generated using superconductive materials. The medical field applications of magnetic resonance imaging has saved countless lives.

In applications using superconductive materials, the magnetic field is generally produced by a superconducting coil that contains the superconductive material. The superconductive material is often in the form of a superconducting wire that is wrapped around a core. The superconductive wire produces a magnetic field inside and outside of the core. The magnetic field can be increased by increasing the number of times the superconductive wire is wrapped around the core and by increasing the current flowing through the superconductive wire. As will be discussed in greater detail below, the magnetic field produces a physical load on each individual superconducting wire. This physical load is generally referred to by those skilled in the art as Lorentz stresses.

Lorentz stresses are produced by the magnetic field acting on the superconductive materials and increase by the square of magnetic field strength. Lorentz stresses produce a mechanical, or operational, load that acts to push the individual superconducting wires away from the core. In conventional superconducting coils, the operational load is transferred outward from each superconducting wire to each outwardly successive superconducting wire until the entire operational load from all the inwardly preceding superconducting wires is transferred to an outer support structure that surrounds the superconducting wires. This is analogous to a stack of bricks, where the top brick only supports its own weight but the bottom brick must support the weight of the entire stack of bricks.

In very high magnetic field applications, the load supported by the outer superconducting wire can be greater than the physical strength of the semiconductor wire. The outer superconducting wire is essentially crushed by the operational loads from the inner superconducting wires. Accordingly, the strength of the magnetic field and the number of superconducting wires that can be layered in a conventional superconducting coil is limited.

As the current through the superconducting wires is increased to produce a very high magnetic field, the high operational loads on the superconducting wires can cause the shape of a conventional superconducting coil to change. The change in shape of the superconducting coil distorts the magnetic field produced by the superconducting coil.

SUMMARY OF THE INVENTION

Accordingly, a need has arisen in the art for an improved superconducting coil and method of stress management in a superconducting coil. The present invention provides an improved superconducting coil and method of stress management in a superconducting coil that substantially eliminates or reduces problems associated with prior systems and methods.

In accordance with one embodiment of the present invention, an improved superconducting coil includes a number of superconducting layers, each having at least one superconducting element which produces an operational load. An outer support structure is disposed outwardly from the plurality of layers. A load transfer system is coupled between at least one of the superconducting elements and the outer support structure. The load transfer system comprises a support matrix structure which transfers the operational load from the superconducting element directly to the outer support structure. A shear release layer is disposed, in part, between the superconducting element and the support matrix structure to relieve shear stress between the superconducting element and the support matrix structure. Similarly, a compliant layer is disposed, in part, between the superconducting element and the support matrix structure to relieve compressive stress on the superconducting element.

Technical advantages of the present invention include providing a superconducting coil that can produce a stronger magnetic field than was structurally possible using conventional superconducting coils.

Another technical advantage of the present invention is that the stresses produced by the operational loads in the superconducting coil are managed such that distortion of the magnetic field is minimized as the current through the superconducting coil is increased.

Another technical advantage of the present invention is that the compliant layer may be used as a cryogenic cooling passage to cool the superconducting elements. Accordingly, the superconducting coil is less likely to have hot spots that will quench the superconducting element.

Yet another technical advantage of the present invention is that the compliant layer maintains the superconducting elements under a constant preload, which acts to reduce the stress on the superconductor elements produced by varying magnetic field strength. In addition, the shear release layer reduces the shear loads in the superconducting elements, thereby reducing the stress on the superconductor element.

Still another technical advantage of the present invention is that the superconducting coil has a scalable configuration such that the coil may be sized to accommodate greater magnetic fields as compared to conventional superconducting coils.

Other technical advantages will be readily apparent to one skilled in the art from the following figures, descriptions, and claims.

BRIEF DESCRIPTION OF THE DRAWINGS

For a more complete understanding of the present invention and its advantages thereof, reference is now made to the following description taken in conjunction with the accompanying drawings, wherein like reference numerals represent like parts, in which.

DETAILED DESCRIPTION OF THE INVENTION

FIGS. 1 through 4 illustrate an improved superconducting coil and method of stress management in a superconducting coil. As described in greater detail below, the improved superconducting coil incorporates a load transfer system that directly transfers the operational loads, caused by Lorentz stresses acting on the superconducting elements, to an outer support structure. The operational loads are transferred to the outer support structure without being transferred through outwardly successive superconducting elements. Accordingly, the improved superconducting coil can be used to produce high strength magnetic fields that were previously unattainable with conventional superconducting coils. In addition, the magnetic coil is resistant to shape distortion during operation at high magnetic field strengths.

Figure 1:
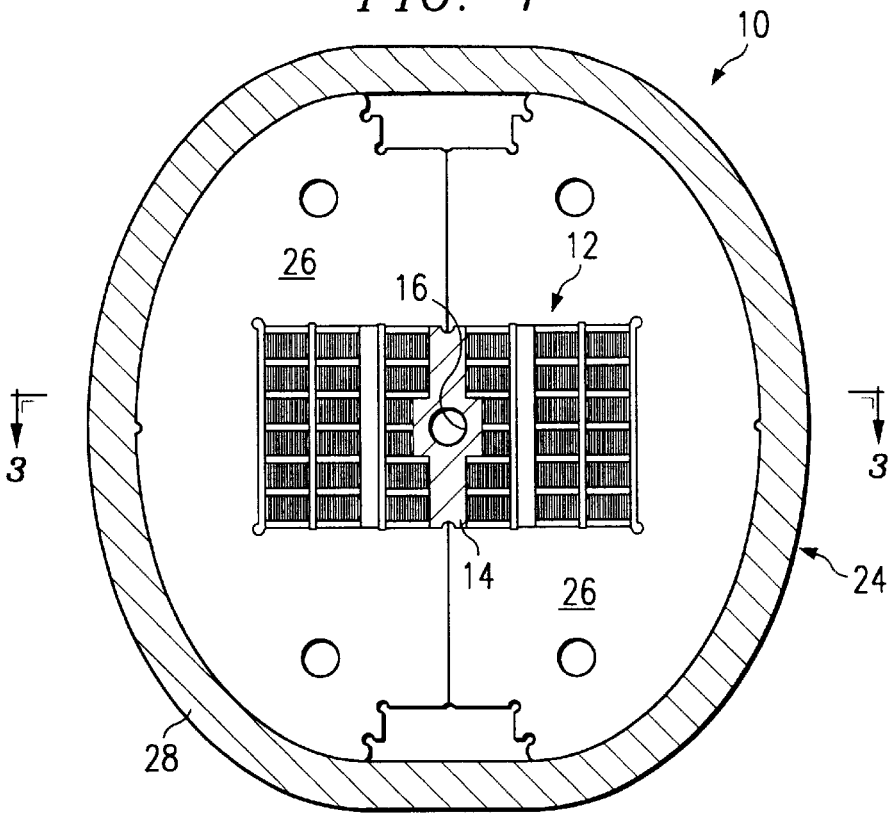
FIG. 1 is a cross-sectional diagram of a superconducting magnet having a superconducting coil constructed in accordance with the present invention.

FIG. 1 is a cross-sectional diagram of a dipole superconducting magnet 10 comprising a superconducting coil 12. Although the superconducting coil 12 is illustrated in terms of the superconducting magnet 10, it shall be understood that the superconducting coil 12 may be used in any suitable application without departing from the scope of the present invention. For example, the superconducting coil 12 may be used in electric motors, generators, transformers, magnetic energy storage devices, magnetic bearings, colliders, or any other suitable application.

The superconducting magnet 10 comprises a core 14 disposed within the superconducting coil 12. In the embodiment illustrated, the core 14 forms a cavity 16. In this embodiment, the superconducting coil 12 produces a magnetic field within the cavity 16 that may be used for various applications. For example, in high-energy collider applications, the cavity 16 is a beam passage in which the magnetic field within the beam passage controls the movement of a beam of charged particles traveling through the beam passage. In electric motor applications, the cavity 16 includes a rotor (not shown) located within the cavity 16. The magnetic field produced within the cavity 16 acts on the rotor to rotate the rotor.

In another embodiment, the cavity 16 is not formed within the core 14. In this embodiment, the magnetic field produced externally from the superconducting coil 12 can be used for various applications. For example, in magnetic resonance downhole logging instruments, the external magnetic field may be used to map the oil bearing formations in the earth surrounding a borehole.

Figure 2:
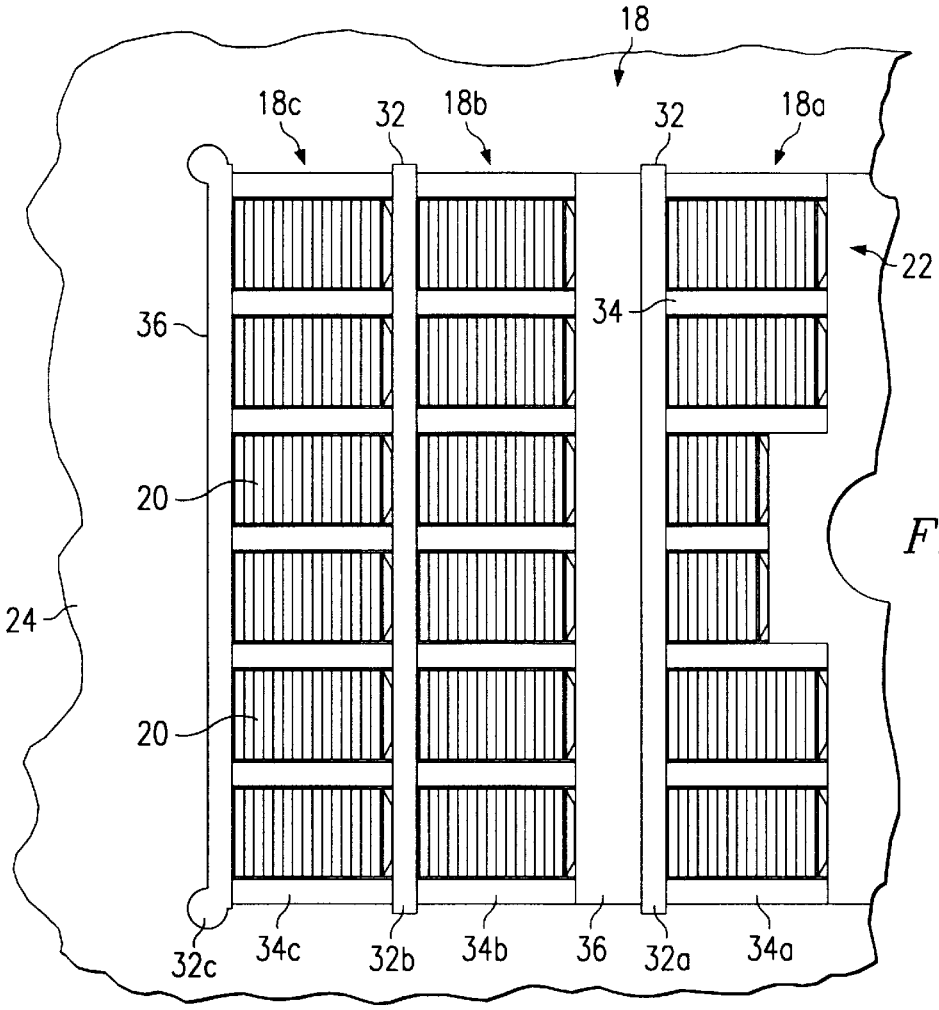
FIG. 2 is a portion of the cross-sectional diagram shown in FIG. 1, and illustrates a top view of a load transfer system constructed in accordance with the present invention.

As shown in FIG. 2, the superconducting coil 12 comprises a number of superconducting layers 18. Each superconducting layer 18 has at least one superconducting element 20. As will be discussed in greater detail below, the superconducting elements 20 in the superconducting layers 18 contain a superconductive material. The flow of electrical current through the superconductive elements 20 produces the magnetic field. The greater the electrical current passing through the superconductive elements 20 and the greater the number of superconducting elements 20 conducting the electrical current, the greater the strength of the magnetic field produced by the superconducting coil 12.

The magnetic field produces an operational load on the each superconducting element 20 that increases in proportion to the magnetic field acting on the superconducting element 20 and the electrical current carried by the superconducting element 20. The operational load, or Lorentz stress, is a mechanical force acting on the superconducting elements 20 to push the superconducting elements 20 away from the core 14.

As will be discussed in greater detail below, the superconducting coil 12 also comprises a load transfer system 22 that operates to transfer the operational loads from the superconducting elements 20 such that the total operating load acting on a superconducting element 20 never exceeds the structural strength of the superconducting element 20. In contrast, conventional superconducting coils transfer the operating loads through successive outward layers until the total operating load is reacted by the outermost layer of superconducting elements. The structural strength of the superconducting element limits the magnetic field strength that can be attained in conventional superconducting coils.

The load transfer system 22 transfers the operational load from at least one of the superconducting elements 20 to an outer support structure 24. The outer support structure 24 reacts to the operational loads produced by the superconducting elements 20 and maintains the superconducting layers 18 and the superconducting elements 20 in a fixed position. In one embodiment, the outer support structure 24 comprises a restraining structure 26 and a preload band 28. In this embodiment, the preload band 28 compressively preloads the load transfer system 22 and the restraining structure 26 such that higher operational loads associated with high strength magnetic fields can be achieved. It will be understood that the outer support structure 24 may comprise other suitable devices without departing from the scope of the present invention.

Figure 3:
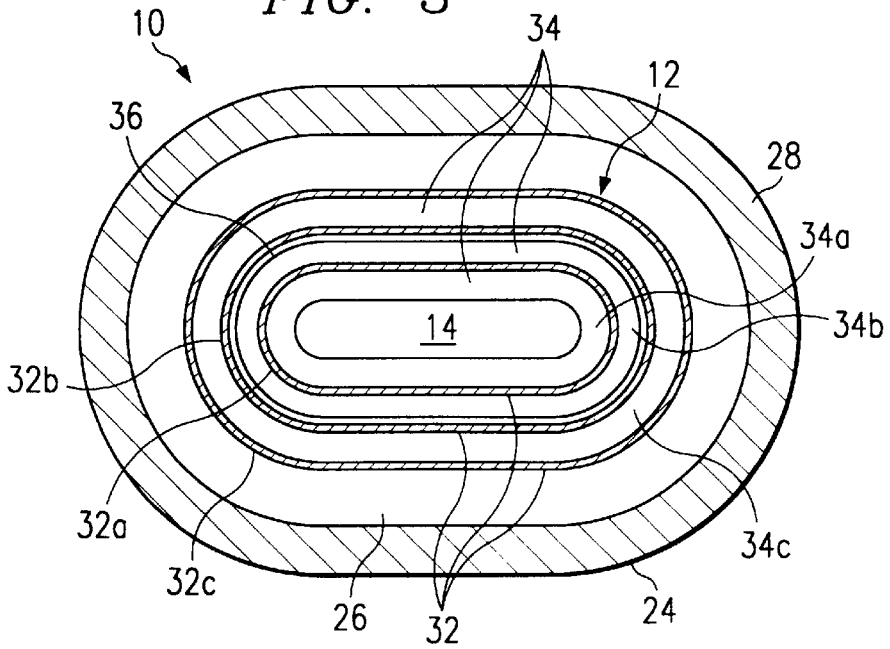
FIG. 3 is a cross-sectional diagram of the superconducting magnet of FIG. 1 taken along line 3—3, and illustrates a top view of the load transfer system shown in FIG. 2.

FIGS. 2 and 3 illustrate a side view and a top view, respectively, of a portion of the load transfer system 22. In the embodiment illustrated in FIGS. 2 and 3, the load transfer system 22 comprises a support matrix structure 30 coupled between each superconducting element 20 and the outer support structure 24. The support matrix structure 30 operates to transfer the operational loads from each superconducting element 20 in each superconducting layer 18 to the outer support structure 24 without transmitting the operational load through outwardly successive superconducting elements 20.

The support matrix structure 30 includes a number of plates 32 and ribs 34. A plate 32 is generally disposed between each pair of superconducting layers 18. A rib 34 is generally disposed between each superconducting element 20. In one embodiment, each rib 34 is a single-piece design that provides structural support to the plate 32 located inwardly from the rib 34. In another embodiment, the plate 32 is a single-piece design that provides structural support to the rib 34 located inwardly from the plate 32.

In the particular embodiment illustrated in FIGS. 2 and 3, the superconducting coil 12 comprises a first, second, and third superconducting layer, 18*a*, 18*b*, and 18*c*, respectively, of superconducting elements 20. The support matrix structure 30 comprises a first, second, and third layer plate, 32*a*, 32*b*, and 32*c*, respectively, coupled to a number of first, second, and third layer ribs, 34*a*, 34*b*, and 34*c*, respectively. The first layer ribs 34*a* are disposed between the core 14 and the first layer plate 32*a*. A spacer plate 36 is disposed between the first layer plate 32*a* and the superconducting elements 20 that comprise the second superconducting layer 18*b*. The spacer plate 36 separates the first and second superconducting layers, 18*a* and 18*b*, respectively, to provide a more uniform magnetic field in the cavity 16. The second layer ribs 34*b* are disposed between the spacer plate 36 and the second layer plate 32*b*. The third layer ribs 34*c* are disposed between the second layer plate 32*b* and the third layer plate 32*c*. The third layer plate 32*c* is coupled to the outer support structure 24. It will be understood that the support matrix structure 30 may include other suitable structures without departing from the scope of the present invention. For example, the number of superconducting layers 18 may be increased or decreased depending upon the application. In addition, the number of plates 32 and ribs 34 may be varied depending upon the operational loads associated with a particular application.

Figure 4:
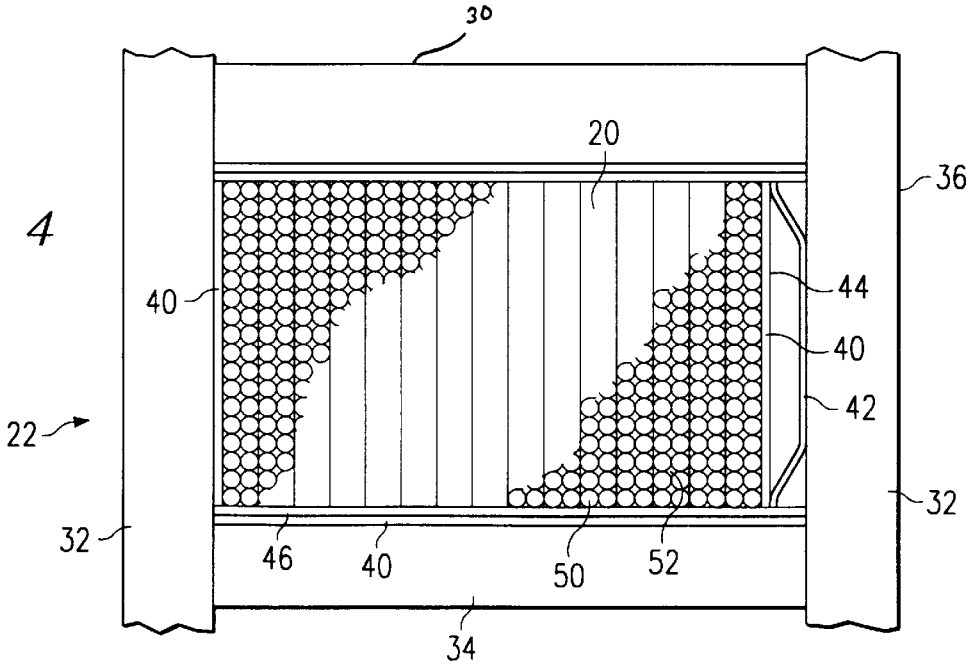
FIG. 4 is a portion of the cross-sectional diagram shown in FIG. 2, and further illustrates the load transfer system in accordance with the present invention.

FIG. 4 is a portion of the cross-section shown in FIG. 2 and further illustrates the load transfer system 22. In addition to the support matrix structure 30, the load transfer system 22 also comprises a shear release layer 40 between the superconducting element 20 and the support matrix structure 30. The shear release layer 40 provides ground-plane insulation and shear relief between the superconducting element 20 and the support matrix structure 30. Shear relief between the superconducting element 20 and the support matrix structure 30 is required to remove any shear stresses that would accumulate in the superconducting element 20 as the support matrix structure 30 is compressed by the operational loads of the various superconducting elements 20. In one embodiment, the shear release layer 40 comprises multiple layers of mica paper. It will be understood that the shear release layer 40 may comprise other suitable materials without departing from the scope of the present invention.

The load transfer system 22 also comprises a compliant layer 42 between an inner surface 44 of the superconducting element 20 and the support matrix structure 30. The compliant layer 42 maintains a substantially constant preload on the superconducting element 20 as the support matrix structure 30 is compressed by the operational loads of the various superconducting elements 20. In other words, the compliant layer 42 acts as a gap that allows the support matrix structure 30 to be compressed without compressing the superconducting elements 20. In one embodiment, the complaint layer 42 is a laminar spring that is sealed within a housing (not expressly shown). In this embodiment, the laminar spring provides approximately 10 Mpa of preload to each respective superconducting element 20 and can be used as a coolant flow passage to deliver cryogenic fluids to directly cool the superconducting elements 20. It will be understood that the complaint layer 42 may comprise other suitable devices without departing from the scope of the present invention.

Although the load transfer system 22 has been described with reference to the support matrix structure 30, the shear release layer 40, and the compliant layer 42, it will be understood that the load transfer system 22 may comprise other suitable devices for transferring the operational load from the superconducting elements 20 to the outer support structure 24 without departing from the scope of the present invention.

A heating system 46 may be located in close proximity to each individual superconducting element 20. When activated, the heating system 46 produces heat and raises the temperature of the individual superconducting elements 20. When the temperature of the superconductive material within the superconducting elements 20 is raised above the critical temperature, the superconductive material no longer has zero resistance, and the electric current flowing through the superconducting elements 20 generates heat within the superconducting elements 20. This process safely quenches the entire superconducting coil 12 without damage to the individual components in the superconducting coil 12.

As discussed previously, the superconducting elements 20 contain the superconducting material through which electrical current flows to produce the magnetic field. As best illustrated in FIG. 4, the superconducting element 20 may comprise a number of superconducting strands 50 coupled together by a binding matrix 52. Each of the superconducting strands 50 contain the superconductive material. In one embodiment, the superconducting strands 50 contain multiple superconducting wire strands as disclosed in U.S. Provisional patent application entitled, Armored Spring-Cure Cable for High Temperature Superconductors, Ser. No. 60/081,008, filed Mar. 30, 1998, and incorporated herein by reference. In one embodiment, the superconductive material is a high temperature superconductor. High temperature superconductors have a generally crystalline ceramic structure and are very sensitive to loads. Most high temperature semiconductors are activated after they have been formed into their final shape due to their inability to react loads. For this reason, the present invention is uniquely suited to make use of high temperature semiconductor materials. It will be understood that the superconducting strands 50 may be otherwise configured without departing from the scope of the present invention. For example, the superconducting strands 50 may be a single superconducting wire, or any suitable variant.

The binding matrix 52 may be formed by impregnating an epoxy material into the voids surrounding the superconducting stands 50. The binding matrix 52 is generally formed after the superconducting strands 50 have been wound. It will be understood that the binding matrix 52 may be otherwise formed without departing from the scope of the present invention.

The operation of the load transfer system 22 is best illustrated by referring to FIG. 2. In this embodiment, the outer support structure 24 preloads the support matrix structure 30 in compression. As the superconducting coil 12 is energized to produce a magnetic field, the operational load from each superconducting element 20 in the first superconducting layer 18*a* is applied to a first layer plate 32*a*, which in turn transfers the operational load through the spacer plate 36 to the second layer ribs 34*b*. The second layer ribs 34*b* transfer the operational load from the first superconducting layer 18*a* to the second layer plate 32*b*. In addition to the operational load from the first superconducting layer 18*a*, the operational load from each superconducting element 20 in the second superconducting layer 18*b* is applied to the second layer plate 32*b*. The second layer plate 32*b* then transfers the operational load from the first and second superconducting layers, 18*a* and 18*b*, respectively, to the third layer ribs 34*c*. The third layer ribs 34*c* transfer the operational load from the first and second superconducting layers, 18*a* and 18*b*, respectively, to the third layer plate 32*c*. In addition to the operational load from the first and second superconducting layers, 18*a* and 18*b* respectively, the operational load from each superconducting element 20 in a third layer 18*c* is applied to the third layer plate 32*c*. The third layer plate 32*c* transfers the operational load from the first, second, and third layers, 18*a*, 18*b*, and 18*c*, respectively, to the outer support structure 24.

The cumulative loads applied to the support matrix structure 30 compress the ribs 34*a*, 34*b*, and 34*c*. The shear release layer 40 allows the ribs 34*a*, 34*b*, and 34*c* to deflect under compression without imparting a shear stress into the adjoining superconducting elements 20.

Similarly, the compliant layer 42 allows the ribs 34 to deflect under compression without imparting a compressive stress into the superconducting elements 20. In other words, the compliant layer 42 prevents the superconducting elements 20 from becoming a structural load carrying member in the superconducting coil 12.

In short, the support matrix structure transfers the operational loads from the superconducting elements to the outer support structure without the operational loads being transferred through the superconducting elements in successive superconducting layers. Accordingly, the superconducting coil is not limited in the number of superconducting layers that can be incorporated into the superconducting coil. In addition, the strength of the magnetic field produced by the superconducting coil is not limited by the structural ability of the superconducting elements in the outermost superconducting layer to react the total operational loads from the other superconducting elements. Furthermore, the reduction in the total stress acting on the superconducting elements reduces the variation in the shape of the superconducting coil, and therefore, the distortion in the magnetic field is correspondingly reduced. Moreover, the reduction in total stress acting on the superconducting elements allows high temperature superconductor materials to be used as the superconductive material.

Although the present invention has been described with several embodiments, various changes and modifications may be suggested to one skilled in the art. It is intended that the present invention encompass such changes and modifications that follow within the scope of the appended claims.

What is claimed is:

1. A superconducting coil comprising:

a plurality of superconducting layers with each superconducting layer having at least one superconducting element and each superconducting element producing an operational load;

an outer support structure disposed outwardly from the plurality of layers; and a load transfer system coupled between at least one of the superconducting elements and the outer support structure, the load transfer system comprising:

a support matrix structure operable to transfer the operational load from the superconducting element directly to the outer support structure;

a shear release layer disposed, in part, between the superconducting element and the support matrix structure for relieving a shear stress between the superconducting element and the support matrix structure; and a compliant layer disposed, in part, between the superconducting element and the support matrix structure configured to relieve a compressive stress on the superconducting element.

2. The superconducting coil of claim 1, wherein the support matrix structure comprises a plate disposed between adjacent superconducting layers with at least one rib disposed between adjacent plates and at least one rib disposed between the outer support structure and the adjacent plate.

3. The superconducting coil of claim 1, wherein the support matrix structure comprises:

a plate disposed between at least two adjacent superconducting layers;

at least one rib disposed between the plate and the outer support structure.

4. The superconducting coil of claim 1, wherein the compliant layer is a laminar spring.

5. The superconducting coil of claim 1, wherein the shear release layer is formed from at least one layer of mica paper.

6. The superconducting coil of claim 1, further comprising a heating system proximate the superconducting elements.

7. The superconducting coil of claim 1, wherein the compliant layer is a spring.

8. The superconducting coil of claim 1, wherein the shear release layer is formed from at least one layer of mica paper.

9. The superconducting coil of claim 1, wherein the compliant layer is further configured to provide a substantially constant preload on the superconducting element during operational loading of the matrix support structure.

10. The superconducting coil of claim 1, wherein each superconducting element comprises:

a plurality of cable elements with each cable element having a plurality of strands of a superconductive material; and a binding matrix restraining the cable elements.

11. The superconducting coil of claim 10, wherein the superconductive material is a high temperature superconductive material.

12. The superconducting coil of claim 10, wherein the binding structure is an impregnated epoxy material.

13. A superconducting coil for an electromagnetic device comprising:

an inner superconducting layer and an outer superconducting layer;

an outer support structure disposed outwardly from the outer superconducting layer; and a load transfer system coupled between the inner superconducting layer and the outer support structure, the load transfer system operable to transfer an operating load from the inner superconducting layer to the outer support structure, the load transfer system comprising:

a support matrix structure operable to transfer the operational load from the inner superconducting layer to the outer support structure;

a shear release layer for relieving a shear stress between the inner superconducting layer and the support matrix structure; and a compliant layer configured to relieve a compressive stress on the superconducting layer.

14. The superconducting coil of claim 13, wherein the support matrix structure comprises a plate disposed between the inner and outer superconducting layers with at least one rib disposed between the plate and the outer support structure.

15. The superconducting coil of claim 13, wherein the superconducting electromagnetic device is a superconducting magnet.

16. The superconducting coil of claim 13, wherein the compliant layer is further configured to provide a substantially constant preload on the inner superconducting layer during operational loading of the inner superconducting layer.

17. A method of stress management in a superconducting coil comprising the steps of:

providing a plurality of superconducting layers with each superconducting layer having at least one superconducting element and each superconducting element producing an operational load;

providing an outer support structure disposed outwardly from the plurality of layers;

transferring the operational load from at least one of the superconducting elements to the outer support structure without transferring the operational load through another superconducting element; and providing a compliant layer configured to relieve a compressive stress on the superconducting element.

18. The method of claim 17, further comprising the step of relieving a shear stress in the superconducting elements.

19. The method of claim 17, wherein the step of providing a compliant layer further comprises maintaining a substantially constant preload on the superconducting element during operational loading.

20. The method of claim 15, wherein the step of providing a compliant layer further comprises providing a compliant layer configured to allow coolant flow to the superconducting element.

* * * * *